United States Patent [19]

Wachi

[11] Patent Number: 4,604,960

[45] Date of Patent: Aug. 12, 1986

[54] APPARATUS FOR CLEANING UNDERWATER SURFACES

[75] Inventor: Kiyoshi Wachi, Machida, Japan

[73] Assignee: Macsea Marine Services Company, Inc., Tokyo, Japan

[21] Appl. No.: 687,423

[22] Filed: Dec. 28, 1984

[30] Foreign Application Priority Data

Apr. 4, 1984 [JP] Japan ..... 59-49564[U]

[51] Int. Cl.[4] ..... B63B 59/00

[52] U.S. Cl. ..... 114/222; 114/121; 114/124

[58] Field of Search ..... 114/222, 221, 312, 256, 114/257, 317, 333, 52, 53, 121, 124, 125, 126; 441/28, 29

[56] References Cited

U.S. PATENT DOCUMENTS

| | | | |
|---|---|---|---|
| 3,083,671 | 4/1963 | Ripley | 114/124 |
| 3,362,367 | 1/1968 | Rosfelder | 114/124 |
| 4,014,280 | 3/1977 | Laxo | 114/124 |
| 4,236,477 | 12/1980 | Norris | 114/222 |
| 4,270,484 | 6/1981 | Shimatani | 114/222 |
| 4,314,521 | 2/1982 | Lundberg | 114/222 |
| 4,378,748 | 4/1983 | Kurtz | 114/124 |

*Primary Examiner*—Trygve M. Blix
*Assistant Examiner*—C. T. Bartz
*Attorney, Agent, or Firm*—Wenderoth, Lind & Ponack

[57] ABSTRACT

Apparatus for cleaning underwater surfaces and including at least one rotatable brush, and at least one pump the generating a stream of water passing from the front to the rear of the brush to hold the apparatus against an object to be cleaned. The apparatus can be readily manipulated and held in any desired attitude as a result of the brush being surrounded by an annular tube containing two immiscible materials of different specific gravity, such as a solid and a liquid, or two immiscible liquids.

6 Claims, 5 Drawing Figures

APPARATUS FOR CLEANING UNDERWATER SURFACES

BACKGROUND OF THE INVENTION

1. Field of the Invention

The present invention relates to a cleaning apparatus adapted to the removal of substances stuck to underwater surfaces of ships or other structures, such as sea weeds and shells.

2. Description of the Prior Art

A conventional cleaning apparatus of this kind is provided with a rotary brush for use underwater and with a pump for generating a water stream that flows in the direction from the front side of said rotary brush to the rear side thereof. Usually a diver carries said cleaning apparatus, operates the apparatus so that the front side of the rotary brush can touch an object to be cleaned and drives the pump to turn the rotary brush. The water stream generated by driving the pump causes the front side of the rotary brush to stick to the object to be cleaned, and the turning of the rotary brush removes substances stuck to the object.

However, since such a cleaning apparatus is usually designed to hold its attitude horizontally due to buoyancy, it must be handled, so that if the surface of the object to be cleaned stands vertically or nearly vertically, the front side of the rotary brush will face the surface of the object. Further, if the cleaning apparatus is held vertically or nearly vertically, buoyancy always acts so as to restore the attitude of the cleaning apparatus to a horizontal position, whereby the balance of the apparatus underwater becomes inevitably unstable, causing trouble in underwater operation and reducing workability.

SUMMARY OF THE INVENTION

In view of the above, the present invention provides an apparatus for cleaning underwater objects, aiming at maintaining the balance of the cleaning apparatus, ease of operation of the apparatus, and secure and efficient cleaning work underwater. The invention features rotary brushes that can come into contact with the object to be cleaned, pumps for generating water streams that flow in the direction from the front side of said rotary brushes to the rear side thereof and a tube unit which is provided annularly to surround said rotary brushes and pumps. The tube unit is a combination of two kinds of substances which are different in specific gravity from each other, that is, a combination of two liquids or a combination of a liquid and a solid, and is hermetically sealed.

BRIEF DESCRIPTION OF THE DRAWINGS

The attached drawings show an example of a preferred embodiment of the present invention.

DESCRIPTION OF THE PREFERRED EMBODIMENT

Figure 1:
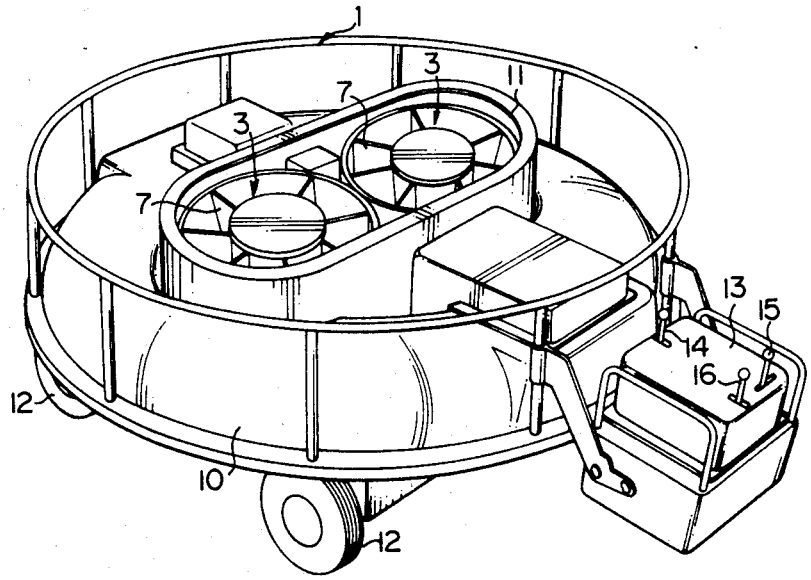
FIG. 1 shows a perspective view.
Figure 2:
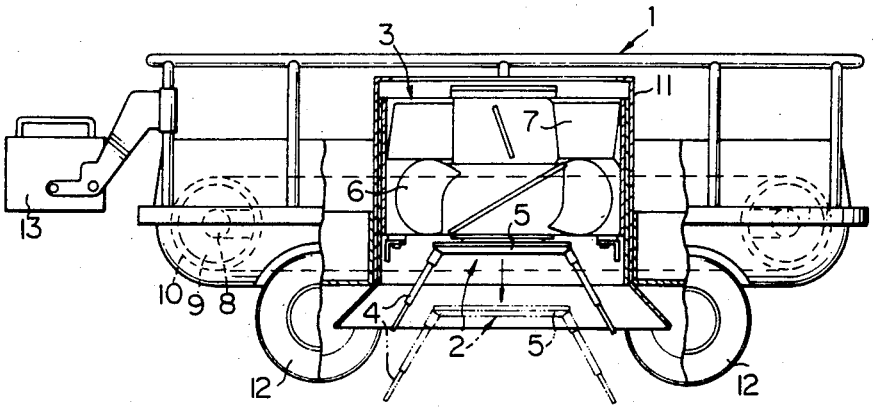
FIG. 2 is a partially broken elevation of the cleaning apparatus shown in FIG. 1.

The following will describe the present invention in detail based on the preferred embodiment shown in the attached drawings.

In the attached drawings, reference numeral 1 designates the cleaning apparatus proper, and this cleaning apparatus proper 1 is provided with two rotary brushes 2 that can come into contact with an object to be cleaned and with two pumps 3 for generating water streams that flow in the direction from the front side of said rotary brushes 2 to the rear side thereof.

Figure 3:
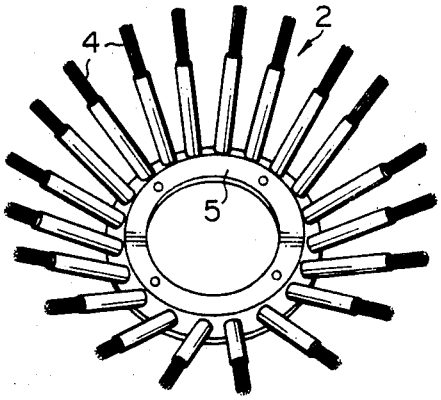
FIG. 3 is a perspective view of the rotary brush in the cleaning apparatus shown in FIG. 1.

Each rotary brush 2 is formed of brushes 4 made of lapped steel or plastic wires and planted radially on ring 5 as shown in FIG. 3, and this ring 5 is connected to the rotary axle of an associated pump 3.

Each pump 3 consists of impeller 6 and stream control plate 7 which is used to convert the spiral vortex jet stream into a uniform stream and jet out the uniform stream. Pumps 3 are is placed facing the associated rotary brushes 2.

Each rotary brush 2 and associated pump 3 are unified via the rotary axle the pump 3, and are turned together by a hydraulic motor (not shown in the attached drawings). Reference numeral 11 is a housing, and rotary brushes 2 and pumps 3 are moved up and down (movements in the direction of the front side of rotary brush 2 and in the direction of the rear side thereof) in housing 11 by a hydraulic cylinder (not shown in the attached drawings).

Further, the action of said hydraulic cylinder moves down (movement of rotary brush 2 in the direction of the front side) rotary brushes 2 and pumps 3 to cause rotary brushes 2 to come into contact with an object to be cleaned, and the action of the hydraulic motor causes impellers 6 for pumps 3 to rotate in order to generate the water stream that flows in the direction from the front side of rotary brushes 2 to the rear side thereof, whereby negative pressure is generated at the side of rotary brushes 2 in the cleaning apparatus proper 1, whereby the cleaning apparatus proper 1 is pressed against this object of cleaning, while the front side of rotary brushes 2 is caused to come into contact with the object, and simultaneously the rotation of rotary brushes 2 which rotate together with pumps 3 removes depositions, etc., from the object.

Reference numeral 8 designates an annular tube unit provided in said cleaning apparatus proper 1 to surround rotary brushes 2 and pumps 3, and this tube unit 8 is filled up with a combination of two kinds of substances which are different in specific gravity, that is, a combination of liquid and a solid or two different liquids, and hermetically sealed. An example of the combination of liquid and a flowable solid substance is a combination of light oil and lead spheres, while one example of the combination of two different liquids immiscible is a combination of light oil and mercury. However, such combination is not limited to these materials.

The two substances are freely flowable in the annulus with respect to each other. Thus, when the cleaning apparatus proper 1 is laid in a horizontal state, tube unit 8 is also laid in a horizontal state, and two kinds of substances which are different in specific gravity and with which tube unit 8 is filled up are evenly distributed over its entire circumference. When the attitude of the cleaning apparatus proper 1 is changed from the horizontal to the vertical states, the cleaning apparatus proper 1 is inclined, and the attitude of tube unit 8 is also inclined in the same direction, and in accordance with this inclination, the substance having greater specific gravity such as lead spheres or mercury move downward, while the substance having smaller specific gravity such as light oil, moves upward. As a result, changes in the attitude of the cleaning apparatus proper 1 from the horizontal to the vertical directions can be actuated by a light force, and also the cleaning apparatus proper 1 can be stably kept in the vertical direction.

Figure 4:
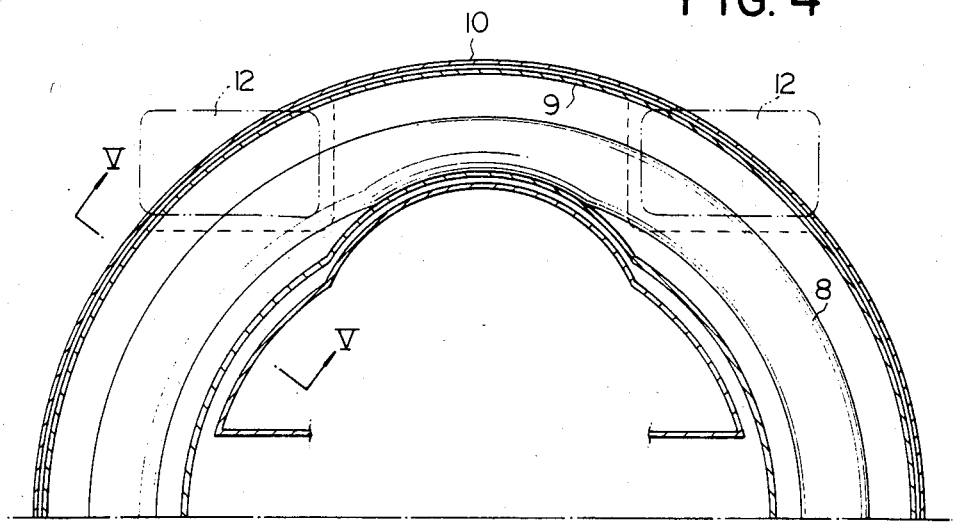
FIG. 4 is an enlarged plan view of a transverse part of the cleaning apparatus shown in FIG. 1.
Figure 5:
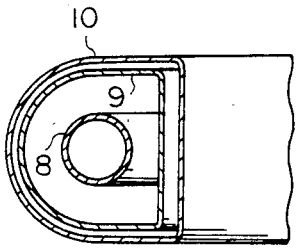
FIG. 5 is a sectional view of the drawing shown in FIG. 4 cut along the V—V line.

Reference numeral 9 designates a buoyant tube unit, and as FIGS. 4 and 5 show, this buoyant tube unit 9 is fitted to the outer circumference of said tube unit 8, such that buoyant tube unit 9 and tube unit 8 constitute a double tube structure. Further, buoyant tube unit 9 is equipped with a water charger that charges water into buoyant tube unit 9, that is, into a space between buoyant tube unit 9 and said tube unit 8, and also is equipped with a water discharger that charges compressed air to the space to discharge the water from the space (both the water charger and discharger are not shown in the attached drawings), and through charging and discharging water to and from buoyant tube unit 9, the cleaning apparatus proper 1 can be moved up and down underwater, and properly positioned underwater.

Reference numeral 10 designates a nearly annular shaped framework that covers buoyant tube unit 9 and contains rotary brushes 2 and pumps 3 in the framework, and reference numeral 12 designates wheels placed at the front side of rotary brushes 2 in the cleaning apparatus proper 1, namely, at the side of rotary brush 2 contacting the object to be cleaned, and these wheels 12 are provided at four places and are driven individually by hydraulic motors (not shown in the attached drawings). Further, as aforementioned, the cleaning apparatus proper 1 that has come into contact with the object to be cleaned due to rotation of pumps 3 moves on the object due to rotation of said wheels 12. Reference numeral 13 designates the operation panel, and reference numerals 14, 15, and 16 designate operating levers, respectively, and when a diver drives operating levers 14, 15, and 16, the cleaning apparatus proper 1 starts cleaning.

In summary, the present invention has the following structure and effects; the cleaning apparatus is provided with rotary brushes that can contact an underwater object to be cleaned, and with pumps that generate water streams flowing in the direction from the front sides of said rotary brushes to the rear side thereof. An annular tube unit is provided to surround said rotary brushes and pumps, and is filled up with a combination of two kinds of substances which are different in specific gravity, that is, a combination of liquid and a solid or two different liquids, and hermetically sealed. When the cleaning apparatus is in a horizontal state, the tube unit is also held in a horizontal state, and the two kinds of substances with which the tube unit is filled up are evenly distributed all over its circumference, and when the cleaning apparatus is changed from the horizontal to a vertical state, the tube unit is inclined to the vertical direction, thereby causing accordingly the substance having greater specific gravity to move downward, and the substance having small specific gravity to move upward, so that changes in the attitude of the cleaning apparatus from the horizontal to the vertical states can be easily done by a light force, and furthermore the cleaning apparatus can be stably held in an inclined state or the vertical state, so that the cleaning apparatus can easily be operated underwater, thereby enabling the apparatus to execute cleaning securely and efficiently.

What is claimed is:

1. An underwater cleaning apparatus, comprising:

at least one rotatable brush having a front side for contact with an underwater object to be cleaned and a rear side opposite said front side;

pump means for generating a water stream flowing from said front side to said rear side;

an annular tube surrounding said at least one brush and pump means; and two immiscible liquids of respectively different specific gravities filling, freely flowably movable with respect to each other in, and hermetically sealed in said annular tube, so that the liquid having greater specific gravity moves downward in said annular tube relative to the other of said two liquids in synchronism with changes in the attitude of said apparatus, thereby to assist in attitude control and facilitate maintenance of a change in attitude of said apparatus.

2. An apparatus as in claim 1, wherein said at least one rotatable brush comprises two rotatable brushes and said pump means comprises two pumps, one pump for each brush.

3. An apparatus as in claim 1, wherein said two liquids comprise oil and mercury.

4. An underwater cleaning apparatus, comprising:

at least one rotatable brush having a front side for contact with an underwater object to be cleaned and a rear side opposite said front side;

pump means for generating a water stream flowing from said front side to said rear side;

and annular tube surrounding said at least one brush and pump means; and a liquid and a mass of flowable solid particles immiscible with respect to said liquid, said liquid and said mass having different specific gravities and filling and being hermetically sealed in said annular tube, said mass and said liquid being freely flowably movable with respect to each other in said annular tube, so that the one of said liquid and said mass having greater specific gravity moves downward in said annular tube relative to the other of said liquid and said mass in synchronism with changes in the attitude of said apparatus, thereby to assist in attitude control and facilitate maintenance of a change in attitude of said apparatus.

5. An apparatus as in claim 4, wherein said at least one rotatable brush comprises two rotatable brushes and said pump means comprises two pumps, one pump for each brush.

6. An apparatus as in claim 4, wherein said liquid comprises oil and said mass comprises lead spheres.

* * * * *